US005766029A

United States Patent [19]

Raison

[11] Patent Number: 5,766,029

[45] Date of Patent: Jun. 16, 1998

[54] CONNECTOR FOR ATTACHING AND MOUNTING AN ELECTRICAL DEVICE ON A WALL OR CEILING

[76] Inventor: Mark Raison, Box 119, Lyndhurst, Ontario, Canada, K0E 1N0

[21] Appl. No.: 744,536

[22] Filed: Nov. 6, 1996

[30] Foreign Application Priority Data

Dec. 5, 1995 [CA] Canada ..... 2164483

[51] Int. Cl.[6] ..... G08B 17/10

[52] U.S. Cl. ..... 439/225; 340/521

[58] Field of Search ..... 439/225; 340/521, 340/522, 628, 632, 693; 362/253, 147

[56] References Cited

U.S. PATENT DOCUMENTS 1,665,987 4/1928 Smith ..... 439/225
2,385,620 9/1945 Fleckenstein ..... 439/225
4,896,145 1/1990 Lewkowicz ..... 340/628

*Primary Examiner*—Neil Abrams
*Attorney, Agent, or Firm*—Gerstman, Ellis & McMillin, Ltd.

[57] ABSTRACT

A connector is provided for attaching and mounting a first electrical device, such as a carbon monoxide detector (36) or a motion detector, to a second electrical device such as a smoke detector (34) or another source of electrical power premounted on the ceiling or wall. The connector comprises an elongated member defining spaced first and second apertures (18,28). At least a portion of the first aperture (18) may extend only partway through the elongated member to provide a back wall which is used for securing the connector to the wall or ceiling. The second aperture (28) extends completely through the elongated member, for receiving the preinstalled second electrical device (34). A channel (32) is defined in the elongated member extending between the first and second apertures, to provide an enclosed space for electric wire (38) to connect between the respective electrical devices mounted in the respective apertures.

14 Claims, 2 Drawing Sheets

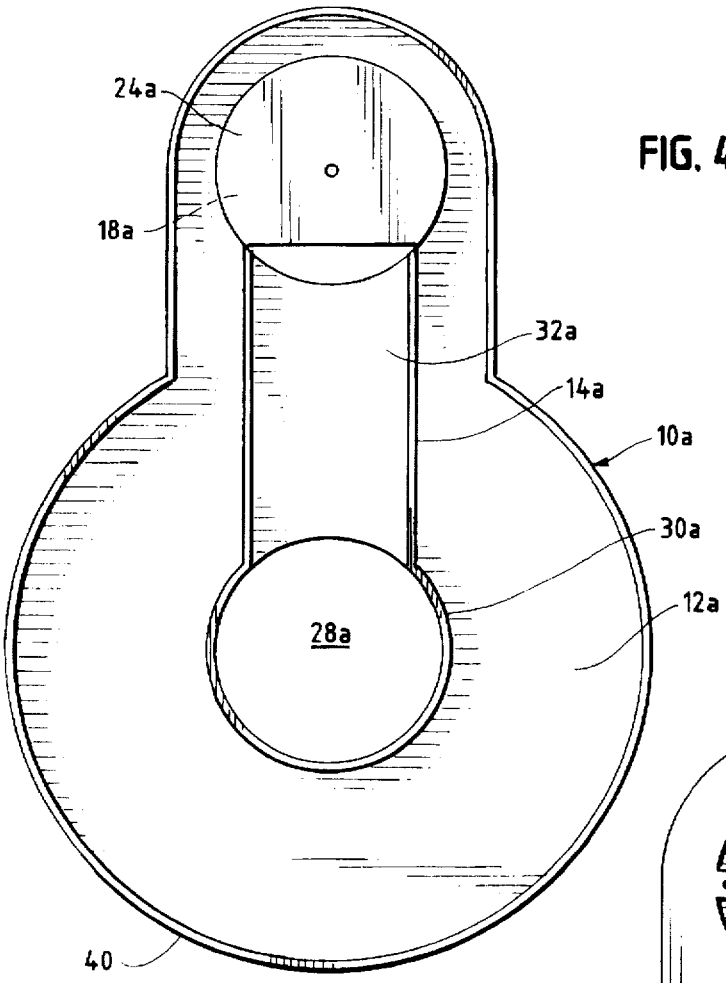
FIG. 4
FIG. 5
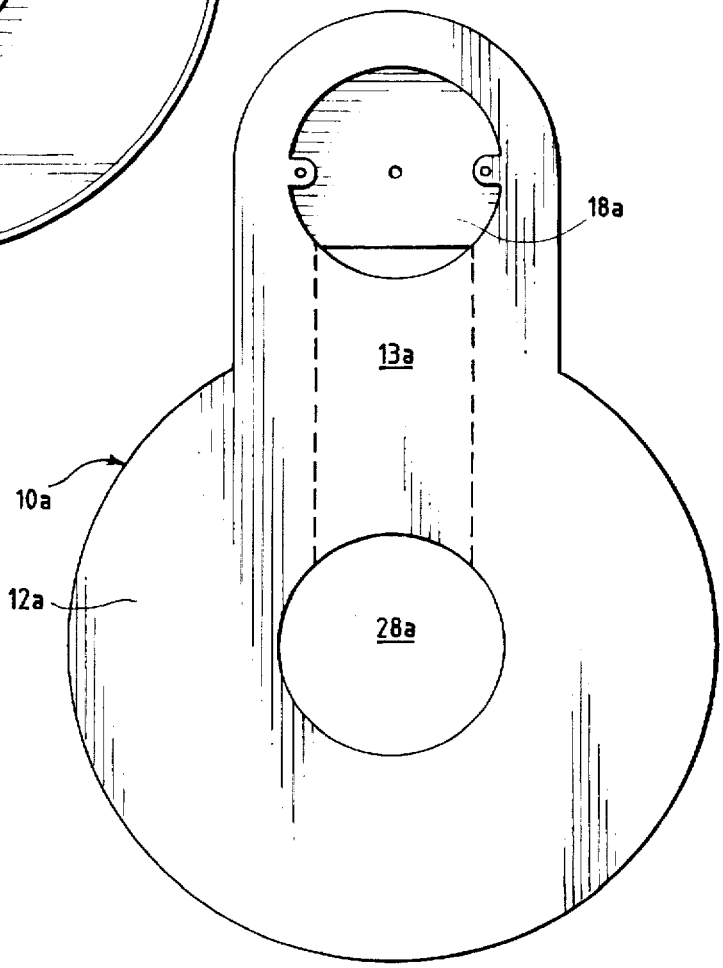

CONNECTOR FOR ATTACHING AND MOUNTING AN ELECTRICAL DEVICE ON A WALL OR CEILING

BACKGROUND OF THE INVENTION

It is well-known that smoke detectors regularly save lives of the inhabitants of buildings. Some data from fire departments shows that most of the fatal fire accidents involve smoke detectors which are battery operated but with inoperative batteries. Accordingly, in some jurisdictions new zoning requirements are being introduced requiring the smoke detectors to be connected to the electrical power of the building.

Additionally, a number of deaths in homes has been attributed to carbon monoxide poisoning, coming from faulty furnaces and other fuel burning appliances. Thus, it is becoming desirable to add a carbon monoxide detector to homes which already have smoke detectors attached to the power system of the home. It of course is an expensive proposition to run conduit through the walls for the carbon monoxide detector to connect it to the power system.

By this invention an alternate, inexpensive device is provided to facilitate the connection of a wall or ceiling-mounted electrical device without the need for placing added electrical conduit in the walls or boring an electric connection through the wall or ceiling. Rather, through the use of the connector of this invention a first electrical device can be attached and mounted to a wall or ceiling and connected to a second electrical device which is already mounted on the wall or ceiling. Thus, the electrical power supply of the one electrical device, such as a smoke detector, can be used to also power the newly added first electrical device, which may be any desired device such as a carbon monoxide detector, a motion detector, or a smoke detector in cases where that is desirable.

DESCRIPTION OF THE INVENTION

By this invention, a connector is provided for attaching and mounting a first electrical device to a second electrical device, the second electrical device being mounted on a wall or ceiling. The connector comprises a body defining spaced first and second apertures. At least a portion of the first aperture typically extends only part way through the body, although a complete aperture may be used if desired. The second aperture extends completely through the body. A channel, extending only part way through is defined in the body, extending between the first and second apertures.

Thus, the connector may be attached for example to the ceiling of a home with the second aperture surrounding and engaging a premounted smoke detector. The first aperture typically has a thin partition so that much of it does not extend completely through the typically elongated body. This resulting partition may be attached by a screw or the like to the ceiling, so that the connector is firmly positioned in place with the smoke detector seated in the first aperture and attached to the ceiling in conventional manner, for example, screws. The electrical power source to which the smoke detector is attached may also be connected to electrical wires that pass from the smoke detector and second aperture, through the channel, to the first aperture and into electrical connection with the first electrical device, such as a carbon monoxide detector.

Thus, by this invention the first electrical device may be mounted conveniently and without breaking through the wall or installing added electrical conduit to the household circuitry.

The connector may be an attractive object to match the decor of the room, surrounding and holding (or being held by) the first and second electrical devices.

Additionally, the first electrical device and the connector may be mounted to a second electrical device which is a socket for a ceiling light or the like, with the light extending down below the connector, for the easy installation of a smoke detector, for example, in conjunction with a ceiling light. Other types of first or second electrical devices may also be used, such as detectors for heat, propane, methane, or other gases.

If desired, the connector may comprise a hollow plastic shell defining the above described apertures and channel. Alternatively, it may be made of a solid structure such as wood or plastic.

The first aperture may be completely open to a side of the connector which is opposed to the channel. The first aperture and the opposed side are facing outwardly as they are mounted to the ceiling or wall.

Thus, an effective, efficient, and economical mounting is provided for wall and ceiling-mounted electrical devices which are connected to line current.

DESCRIPTION OF THE DRAWINGS

In the drawings.

FIG. 4 is a plan view of one side of another embodiment of the connector of this invention, similar to FIG. 1; and FIG. 5 is a plan view of the other side of the connector of FIG. 4.

DESCRIPTION OF SPECIFIC EMBODIMENTS

Figure 2:
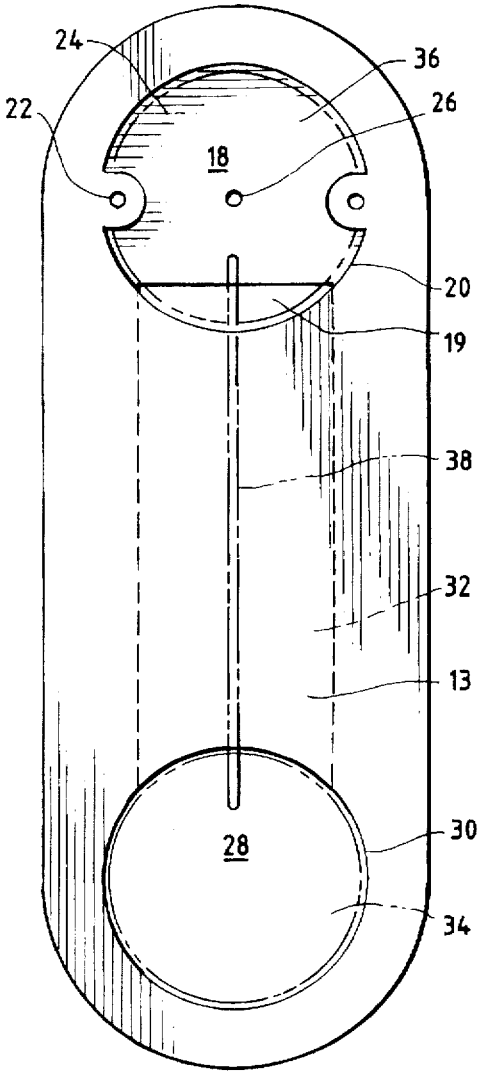
FIG. 2 is a plan view of the other side of the connector of this invention.

Referring to the drawings, connector 10 is provided, comprising an elongated body made of an integral hollow plastic shell 12 as shown. A hollow plastic shell 12 comprises a main sidewall 13 on the side facing the view of FIG. 2 which completely covers the side except for two apertures 18, 28. First sidewall 14 and a peripheral wall 15 in spaced relation to the sidewall 14 are provided. Both sidewalls 14, 15 are perpendicular to main sidewall 13.

First aperture 18 is surrounded by a second, inner, peripheral sidewall 20 which also defines structures for providing screw aperture holes 22. Inner wall 20 joins partition 24, perpendicular to inner wall 20 and covering most of the area of the first aperture 18 on the side of connector 10 opposed to main sidewall 13 so that most of first aperture 18 does not extend completely through the connector structure, but only aperture portion 19 does. A screw hole 26 may be provided in partition 24.

Figure 1:
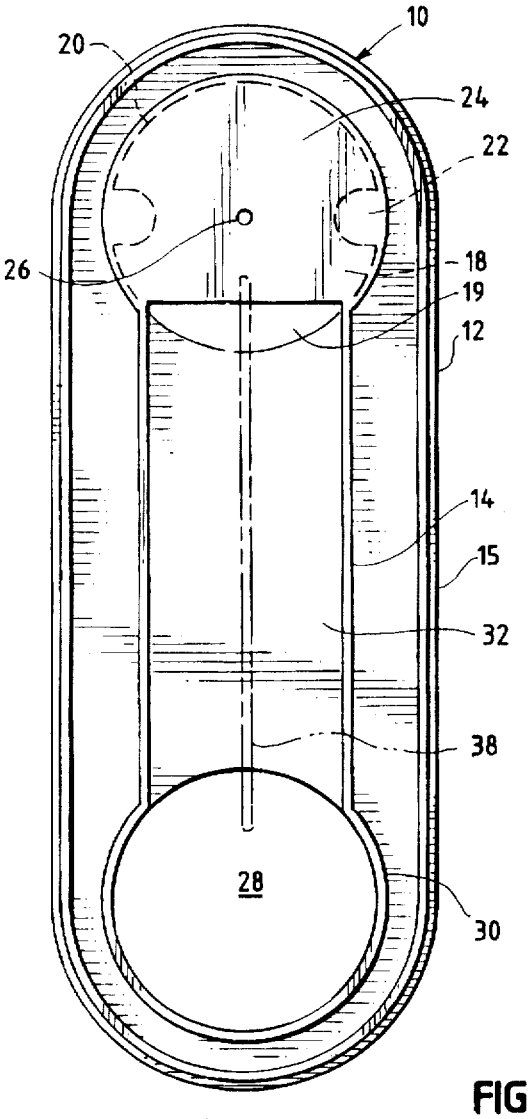
FIG. 1 is a plan view of one side of the connector of this invention.

Second aperture 28 is also provided in shell 12, being surrounded by a third, inner, peripheral sidewall 30. Channel 32 (FIG. 1) is provided by gaps in the respective second and third sidewalls 20, 30 and sidewalls 14.

Accordingly, as previously described, connector 10 may be mounted on the ceiling of a room with second aperture 28 surrounding a smoke detector 34 which is attached to the line current of the house and mounted on the ceiling. The smoke detector 34 may be snugly retained in the aperture 28, being adapted to the particular design thereof if desired.

One may drill a hole in the ceiling which engages with screw hole 26 in the partition 24 of first aperture 18 to secure connector 10 to the ceiling with a screw. Then, the desired first electrical device 36 for attachment is connected to electrical wires 38 which, in turn, are connected to the smoke detector 34 occupying second aperture 28. These electrical wires 38 pass through the channel 32 from the second aperture to the first aperture. These electrical wires are appropriately attached to the electrical device 36 being attached such as a carbon monoxide detector, and the electrical device 36, in turn, may be connected to the shell 12 through the screw aperture holes 22.

Alternatively, connector 10 may be a solid block of wood having apertures 18, 28, channel 32, and optionally partition 24.

Figure 3:
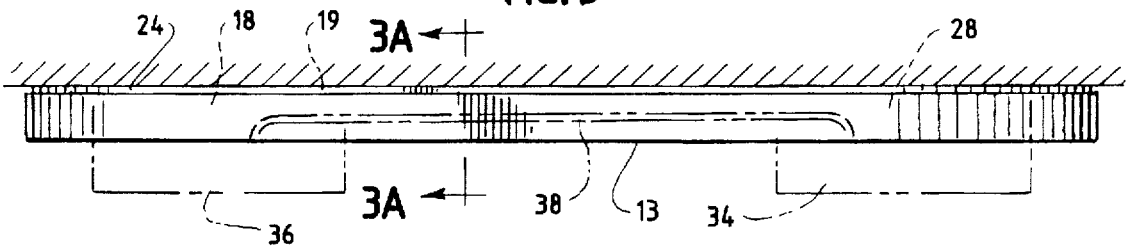
FIG. 3 is a side view of the connector of this invention.
Figure 3A:
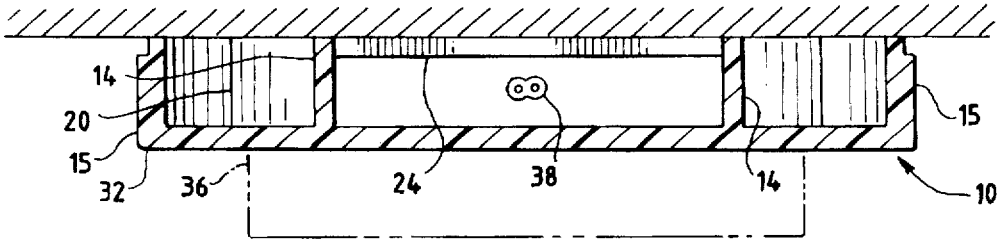
FIG 3A is a transverse sectional view of FIG. 3.

Referring to FIGS. 4 and 5, opposite sides of another embodiment of the connector of this invention are disclosed. The connector 10*a* is basically similar to the connector of FIGS. 1 to 3 except as otherwise described herein, having a pair of apertures 18*a*, 28*a*, and a connecting channel 32*a*, for purposes which are substantially identical to the corresponding elements of the previous embodiment. Partition 24*a* is provided across most of aperture 18*a* as in the previous embodiment, and occupies the side of connector 10*a* opposite to the side that carries main sidewall 13*a*. By way of difference, the hollow plastic shell 12*a* of the connector of FIGS. 4 and 5 comprises an enlarged circular portion 40 surrounding aperture 28*a*, when compared with the previous embodiment. The purpose of this is to permit the connector of FIGS. 4 and 5 to fit underneath a larger base for a ceiling mounted light fixture, while an electrical appliance such as a smoke detector or a carbon monoxide detector is carried on partition 24*a*, covering aperture 18. As before, channel 32*a* provides space for a connecting wire to go from the light fixture mounted adjacent aperture 28*a* to the detector appliance or the like mounted adjacent aperture 18. Plastic sidewalls 30*a* and 19*a* are defined by plastic shell 12*a*.

The above has been offered for illustrative purposes only, and is not intended to limit the scope of the invention of this application, which is as defined in the claims below.

That which is claimed is:

1. A connector for attaching and maintaining a first electrical device to a second electrical device mounted on a wall or ceiling, said connector comprising:

a body defining spaced first and second apertures, said second aperture extending completely through said body, and a channel for electrical wire, extending only partway through said body and extending between said first and second apertures to allow seating of said first electrical device at said first aperture and said second electrical device at said second aperture.

2. The connector of claim 1 in which at least a portion of said first aperture extends only partway through said body.

3. The connector of claim 2 which comprises a hollow plastic shell.

4. The connector of claim 3 mounted on a wall or ceiling in which said second aperture surrounds the second electrical device, and the first electrical device is seated at the first aperture.

5. The connector of claim 4 in which the first aperture is completely open to a side of said connector which is opposed to said channel, said first aperture and side facing outwardly.

6. The connector of claim 2 in which the first aperture is completely open to a side of said connector which is opposed to said channel, said first aperture and side facing outwardly.

7. The connector of claim 6 in which said second electrical device is a smoke detector.

8. The connector of claim 6 in which the first electrical device is a carbon monoxide detector.

9. A connector for attaching and mounting a first electrical device to a second electrical device mounted on a wall or ceiling, said connector comprising:

a body defining spaced first and second apertures, said second aperture seating said second electrical device and the first electrical device being seated at the first aperture and attached to said connector, said second aperture extending completely through said body, and a channel for electrical wire defined in said body connecting the first and second electrical devices in said first and second apertures.

10. The connector of claim 9 in which said second electrical device is a smoke detector and the first electrical device is a carbon monoxide detector.

11. The connector of claim 9 which comprises a hollow plastic shell.

12. A connector for attaching and mounting a first electrical device to a second electrical device mounted on a wall or ceiling, said connector comprising: a body defining spaced first and second apertures to respectively seat said first electrical device and said second electrical device, at least a portion of said first aperture extending only partway through said body, said second aperture extending completely through said body, and a channel for electrical wire defined in said body extending between said first and second apertures, the first aperture being completely open to a side of said connector which is opposed to said channel, said first aperture and side facing outwardly, said connector comprising a hollow plastic shell.

13. The connector of claim 12, mounted on a wall or ceiling in which said second aperture surrounds the second electrical device and the first electrical device is seated at the first aperture.

14. The connector of claim 13 in which said second electrical device is a smoke detector and the first electrical device is a carbon monoxide detector.

* * * * *